US011331771B2

(12) United States Patent
Imura

(10) Patent No.: US 11,331,771 B2
(45) Date of Patent: May 17, 2022

(54) APPARATUS AND METHOD FOR TREATING SURFACE

(71) Applicant: Sintokogio, Ltd., Aichi (JP)

(72) Inventor: Ryota Imura, Aichi (JP)

(73) Assignee: Sintokogio, Ltd., Aichi (JP)

( * ) Notice: Subject to any disclaimer, the term of this patent is extended or adjusted under 35 U.S.C. 154(b) by 298 days.

(21) Appl. No.: 16/634,770

(22) PCT Filed: Jul. 25, 2018

(86) PCT No.: PCT/JP2018/027912

§ 371 (c)(1),
(2) Date: Jan. 28, 2020

(87) PCT Pub. No.: WO2019/064865

PCT Pub. Date: Apr. 4, 2019

(65) Prior Publication Data

US 2020/0206871 A1 Jul. 2, 2020

(30) Foreign Application Priority Data

Sep. 27, 2017 (JP) ..... JP2017-186507

(51) Int. Cl.
*B24C 1/10* (2006.01)
*B08B 5/02* (2006.01)

(52) U.S. Cl.
CPC ..... *B24C 1/10* (2013.01); *B08B 5/023* (2013.01)

(58) Field of Classification Search
CPC .... B24C 1/10; B24C 3/10; B24C 9/00; B08B 5/023
See application file for complete search history.

(56) References Cited

U.S. PATENT DOCUMENTS

| | | | | |
|---|---|---|---|---|
| 9,056,386 | B2 * | 6/2015 | Kobayashi | C21D 7/06 |
| 9,884,407 | B2 * | 2/2018 | Ishikawa | B24C 1/10 |
| 10,755,403 | B2 * | 8/2020 | Safai | G06T 7/0004 |
| 11,045,922 | B2 * | 6/2021 | Iwata | G01B 7/345 |

FOREIGN PATENT DOCUMENTS

| | | | |
|---|---|---|---|
| CN | 103309305 | A | 9/2013 |
| JP | 7-83983 | | 9/1995 |
| JP | 2001-210661 | A | 8/2001 |
| JP | 2002-368016 | A | 12/2002 |
| JP | 2003-127065 | A | 5/2003 |
| JP | 2004-042154 | A | 2/2004 |
| WO | WO 2011/040243 | A1 | 2/2013 |

OTHER PUBLICATIONS

Office Action for corresponding CN 201880046602.7 dated Apr. 2, 2021.
International Search Report for PCT/JP2018/027912 dated Sep. 11, 2018.

* cited by examiner

*Primary Examiner* — Ryan J. Walters
(74) *Attorney, Agent, or Firm* — Finnegan, Henderson, Farabow, Garrett & Dunner, LLP

(57) ABSTRACT

An apparatus and a method for treating a surface to definitely, and with a high quality, finish an object to be processed, are obtained. In the step of a first check, the numbers of objects (W) that are carried into areas (20A, 42A, 74A) where the steps of pre-cleaning, shot peening, and post-cleaning, are carried out, are counted and the conditions of the surfaces of the objects are detected. In the step of a second check, the numbers of objects (W) that are carried out of the areas are counted and the conditions of the surfaces of the objects are detected.

7 Claims, 2 Drawing Sheets

APPARATUS AND METHOD FOR TREATING SURFACE

TECHNICAL FIELD

The present invention relates to an apparatus for treating a surface and a method for treating a surface.

BACKGROUND ART

Various technologies for shot peening have been known (see Patent Literature 1 and Patent Literature 2). For example, Patent Literature 1 discloses a technology to carry out a nondestructive inspection after shot peening.

Incidentally, to finish an object to be processed with a high quality a method for treating a surface that has the steps of cleaning before and after the step of shot peening has been known. However, if such steps are not definitely carried out due to a human error, etc., the object to be processed cannot be definitely finished with a high quality.

Considering these facts, the present invention aims to obtain an apparatus and a method for treating a surface, to definitely and with a high quality finish an object to be processed.

PRIOR-ART PUBLICATION

Patent Literature

[Patent Literature 1] International Publication No. WO 2011/040243

[Patent Literature 2] Japanese Patent Laid-open Publication No. 2004-42154

SUMMARY OF INVENTION

An apparatus for treating a surface of a first aspect of the present invention that treats an object to be processed while transporting the object on a line for treating a surface, wherein the line for treating the surface includes an area for pre-cleaning, an area for projecting, and an area for post-cleaning, that are arranged from an upstream side. The apparatus has a first cleaning device that cleans the object to be processed at the area for pre-cleaning. It also has a shot-peening machine that carries out shot peening by shooting shots on the object to be processed at the area for projecting. It also has a second cleaning device that cleans the object to be processed at the area for post-cleaning. It also has first detecting devices that count, at upstream sides of the line for treating a surface of the area for pre-cleaning, the area for projecting, and the area for post-cleaning, a number of objects to be processed that are carried into the respective areas and that detect the conditions of the surfaces of the objects to be processed. It also has second detecting devices that count at downstream sides of the line for treating a surface of the area for pre-cleaning, the area for projecting, and the area for post-cleaning, a number of objects to be processed that are carried out of the respective areas and that detect the conditions of the surfaces of the objects to be processed.

By this configuration, the first cleaning device cleans the object to be processed at the area for pre-cleaning of the line for treating the surface. The shot-peening machine carries out the shot peening at the area for projecting by shooting the shots on the object to be processed. The second cleaning device cleans the object at the area for post-cleaning.

Here, at the upstream sides of the area for pre-cleaning, the area for projecting, and the area for post-cleaning, the first detecting devices count the number of the objects to be processed to be carried into the respective areas and detect the conditions of the surfaces of the objects to be processed. At the downstream sides of the area for pre-cleaning, the area for projecting, and the area for post-cleaning, the second detecting devices count the number of the objects to be processed to be carried out of the respective areas and detect the conditions of the surfaces of the objects to be processed. By the above operations the number of the objects to be processed and the conditions of the surfaces of them can be evaluated before and after the steps at the area for pre-cleaning, the area for projecting, and the area for post-cleaning. Thus, by such an operation no step can be skipped.

By the apparatus for treating a surface of the second aspect of the present invention, in the configuration of the first aspect, the apparatus for treating a surface has further a control unit that controls operations of the apparatus for treating a surface. The control unit compares the number of objects that have been carried into the areas and the number of objects that have been carried out of the areas based on the number of objects that is counted by means of the first detecting devices and the number of objects that is counted by means of the second detecting devices at a time when the objects that have been carried into the area for pre-cleaning, the area for projecting, and the area for post-cleaning, are carried out of the areas. It outputs an error message if the numbers do not match.

By the above configuration, the control unit compares the number of objects that have been carried into the area for pre-cleaning, the area for projecting, and the area for post-cleaning, with the number of objects that have been carried out of each of the areas when the objects that have been carried into the areas are carried out of the areas, so as to output an error message if the numbers do not match. Thus, any object to be processed that has not been carried out of the areas can be easily found.

By the apparatus for treating a surface of the third aspect of the present invention, in the configuration of the second aspect, the shot-peening machine has a door that is open when the object to be processed is carried into or carried out of the device and that is closed when the shot peening is carried out. It also has a device for detecting that the door is open or closed that detects that the door is open or closed. The control unit counts a number of times that the door has been opened and closed based on the results detected by the device for detecting that the door is open or closed. It also counts a number of times that shot peening has been carried out on the object to be processed that has been carried into the area for projecting.

Incidentally, "the control unit" may consist of multiple control boards, etc. For example, the control unit that outputs an error message based on the number of objects that is counted by means of the first detecting devices and the number of objects that is counted by means of the second detecting devices may be separate from the control unit that outputs an error message based on the number of times that the door has been opened and closed and the number of times that shot peening has been carried out.

By the above configuration, the door is provided to the shot-peening machine and that the door is open or closed is detected by means of the device for detecting that the door is open or closed. The control unit counts a number of times that the door has been opened and closed based on the result detected by the device for detecting that the door is open or closed. It also counts a number of times shot peening has been carried out on the object to be processed that has been carried into the area for projecting. Thus the number of times that the door has been opened and closed can be compared with the number of times that shot peening has been carried out, so as to prevent carrying out the shot peening twice on an object to be processed.

By the apparatus for treating a surface of the fourth aspect of the present invention, in any configuration of the first, the second, and the third aspects, the second detecting devices are configured to include at least either a first nondestructive inspection device that detects electromagnetic characteristics of the object to be processed that has been carried out of the area for projecting or a second nondestructive inspection device that measures, by means of X-rays, a residual stress on a surface of the object to be processed that has been carried out of the area for projecting.

By the above configuration, after the object to be processed is carried out of the area for projecting, at least either one nondestructive inspection to detect the electromagnetic characteristics of the object or one nondestructive inspection to measure the residual stress of the surface of the object is carried out, by means of X-rays. Thus, the effects by the shot peening can be evaluated.

A method for treating a surface of the fifth aspect of the present invention treats a surface of an object to be processed that is sequentially transported through a line for treating the surface that includes an area for pre-cleaning, an area for projecting, and an area for post-cleaning. It has a step of pre-cleaning wherein the object to be processed is cleaned at the area for pre-cleaning. It also has the step of shot peening wherein the object to be processed that has been cleaned in the step of pre-cleaning is subject to the shot peening by shooting the shots on the object at the area for projecting. It also has the step of post-cleaning wherein the object to be processed that has been subject to the shot peening in the step of shot peening is cleaned at the area for post-cleaning. It also has the step of a first check wherein numbers of the objects are counted that are carried into the areas where the step of pre-cleaning, the step of shot peening, and the step of post-cleaning, are carried out, and wherein the conditions of the surfaces of the objects are detected. It also has the step of a second check wherein numbers of objects are counted that are carried out of the areas where the step of pre-cleaning, the step of shot peening, and the step of post-cleaning, are carried out, and wherein the conditions of the surfaces of the objects are detected.

By the above configuration, in the step of pre-cleaning the object to be processed is cleaned at the area for pre-cleaning. In the step of shot peening the object to be processed that has been cleaned in the step of pre-cleaning is subject to the shot peening by shooting the shots on the object at the area for projecting. In the step of post-cleaning the object to be processed that has been subject to the shot peening in the step of shot peening is cleaned at the area for post-cleaning.

When the object to be processed is carried into the areas where the step of pre-cleaning, the step of shot peening, and the step of post-cleaning, are carried out, the step of the first check is carried out. When the object to be processed is carried out of the areas where the step of pre-cleaning, the step of shot peening, and the step of post-cleaning, are carried out, the step of the second check is carried out. By the step of the first check the numbers of objects are counted that are carried into the areas where the step of pre-cleaning, the step of shot peening, and the step of post-cleaning, are carried out, and the conditions of the surfaces of the objects are detected. By the step of the second check the numbers of objects are counted that are carried out of the areas where the step of pre-cleaning, the step of shot peening, and the step of post-cleaning, are carried out, and the conditions of the surfaces of the objects are detected. In this way, since the numbers of, and the conditions of the surfaces of, the objects to be processed are evaluated before and after the step of pre-cleaning, the step of shot peening, and the step of post-cleaning, by such an operation no step can be skipped.

As discussed above, by the apparatus for treating a surface and the method for treating a surface of the present invention a significant advantageous effect can be achieved in that an object to be processed is definitely finished with a high quality.

The basic Japanese patent application, No. 2017-186507, filed Sep. 27, 2017, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

DESCRIPTION OF EMBODIMENTS

Figure 1:
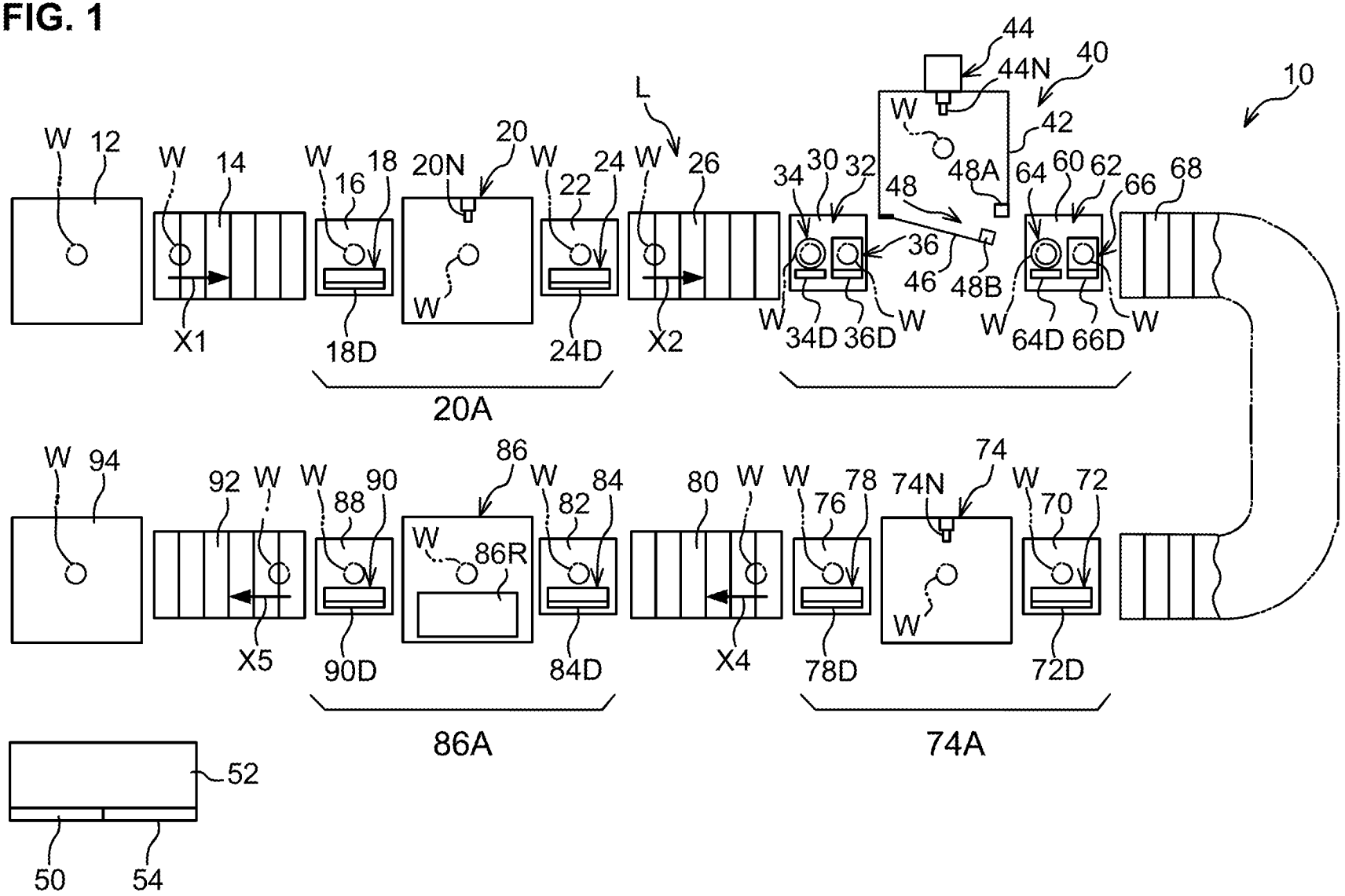
FIG. 1 is a schematic plan view of the apparatus for treating a surface in an embodiment of the present invention.

Below an apparatus for treating a surface and a method for treating a surface of an embodiment of the present invention are discussed with reference to FIGS. 1 and 2. Both figures should be viewed horizontally and the up and down directions and the right and left directions are shown in them. FIG. 1 illustrates a schematic plan view of an apparatus for treating a surface of the present embodiment. First, the apparatus 10 for treating a surface is discussed. Incidentally, an object W to be processed by the apparatus 10 for treating a surface may be a metal product.

A Configuration of the Apparatus for Treating a Surface

As in FIG. 1, the apparatus 10 for treating a surface treats the surface of the object W while the object W is transported from the upstream side to the downstream side. The route for transporting the object W is a line L, for treating the surface. The apparatus 10 for treating a surface has, for example, a table 12 for placing the object W on it and a conveyor 14 at the carrying-in side (the upper-left side in FIG. 1). The conveyor 14 is configured to convey an object W on it in the predetermined conveying direction (the arrow X1). At the downstream side of the conveyor 14 in the line L, a table 16 for temporarily placing the object on it, a first cleaning device 20, and a table 22 for temporarily placing the object on it, are provided. The first cleaning device 20 has a nozzle 20N for blowing air. It cleans the object W by the blown air at an area 20A for pre-cleaning of the line L. Incidentally, the area 20A for pre-cleaning includes the table 16, the first cleaning device 20, and the table 22, in the line L.

A first detecting device 18 is provided on the table 16, which is located at the upstream side (the left side in the figure) of the first cleaning device 20 in the line L. The first detecting device 18 is one that functions as an image-inspecting device. It is located on the table 16 to take an image of the surface of the object W that is carried into the area 20A for pre-cleaning, to generate image data. It detects the condition of the surface of the object W and displays the result on a display 18D. The first detecting device 18 also counts the number of objects W that are carried into the area 20A for pre-cleaning based on the image data, and displays the number on the display 18D.

A second detecting device 24 is provided on the table 22, which is located at the downstream side (the right side in the figure) of the first cleaning device 20 in the line L. The second detecting device 24 is one that functions as an image-inspecting device. It takes an image of the surface of the object W that is carried out of the area 20A for pre-cleaning onto the table 22, to generate image data. It detects the condition of the surface of the object W and displays the result on a display 24D. The second detecting device 24 also counts the number of objects W that are carried out of the area 20A for pre-cleaning based on the image data, and displays the number on the display 24D.

Figure 2:
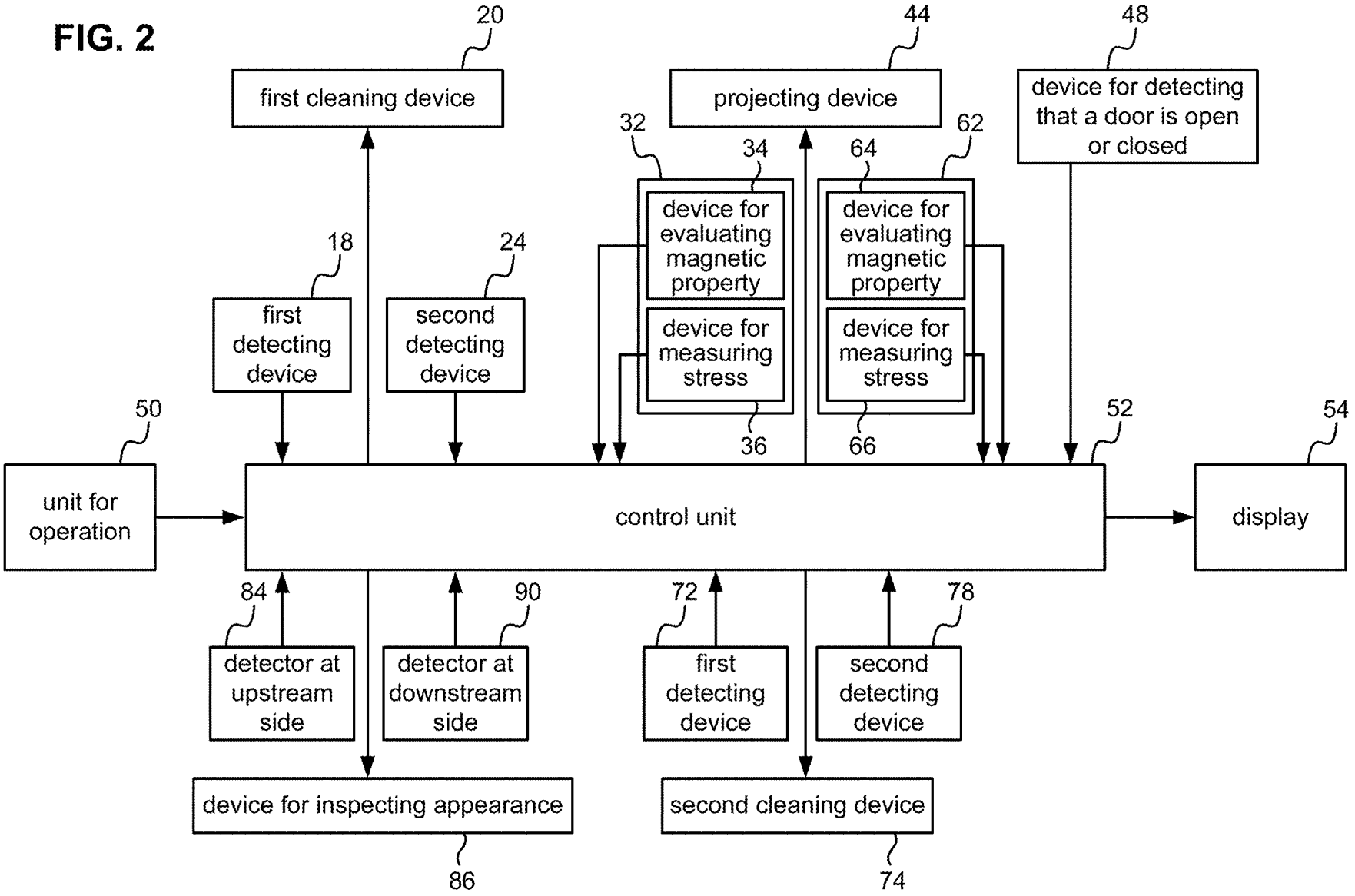
FIG. 2 is a block diagram illustrating a part of the control system of the apparatus for treating a surface of FIG. 1.

As in FIG. 2, the first cleaning device 20, the first detecting devices 18, and the second detecting devices 24, are connected to a control unit 52 that controls the operation of the apparatus 10 for treating a surface. The control unit 52 is connected to a unit 50 for the operation and a display 54, which is a device for displaying. The unit 50 for the operation is configured so that the conditions for cleaning the object W by blowing air by means of the first cleaning device 20 can be input. It is configured to send a signal to the control unit 52 in responding to an input. The control unit 52 comprises, for example, a memory, an arithmetic processing unit, etc. Though a detailed drawing is omitted, the arithmetic processing unit has a CPU, a memory, a storage device, and a communication interface (I/F). They are connected to each other through a bus. The storage device stores a program for arithmetic processing. The memory and the arithmetic processing unit are connected through the communication interface (I/F) to communicate with each other. In the control unit 52, for example, a controller (not shown) for the area 20A for pre-cleaning and a controller (not shown) for the apparatus 10 for treating a surface may be separate controllers. The words "control unit 52" are used to include these controllers.

The control unit 52 compares the number of objects W that have been carried into the area 20A for pre-cleaning (see FIG. 1) with the number of objects W that have been carried out of the area 20A for pre-cleaning (see FIG. 1) at a time when all the objects W that have been carried into the area 20A for pre-cleaning (see FIG. 1) have been carried out of it. This comparison is initiated manually or automatically by using a timer, etc. It is based on the data on the number of objects W obtained by the first detecting devices 18 and the second detecting devices 24. If the numbers do not match, the control unit 52 causes an error message on the mismatching to be displayed on the display 54, or in a general way outputs the error message.

As in FIG. 1, a conveyor 26 is provided to the downstream side (the right side in the figure) of the table 22 in the line L. The conveyor 26 is configured to convey an object W on it in the predetermined conveying direction (the arrow X2).

A table 30 for temporarily placing the object on it, a shot-peening machine 40, and a table 60 for temporarily placing the object on it, are provided to the downstream side of the conveyor 26 in the line L. The shot-peening machine 40 is configured to carry out the shot peening by shooting the shots on the object W in a cabinet 42. Incidentally, the area 42A for projecting (the area at the downstream side of the area 20A for pre-cleaning in the line L) includes the table 30, the shot-peening machine 40, and the table 60.

The basic structure of the shot-peening machine 40 may be one that has been publicly known. For example, one is almost the same as the structure that is disclosed in Japanese Patent Laid-open Publication No. 2012-101304. A nozzle 44N of a projecting device 44 (shown as a block) is provided on the inner side of the cabinet 42. The projecting device 44 injects compressed air that includes shots through the nozzle 44N to shoot the shots on the object W within the cabinet 42.

As in FIG. 2, the projecting device 44 is connected to the control unit 52. The unit 50 for the operation, which is connected to the control unit 52, is configured so that the conditions for shooting the shots on the object W can be input. It is configured to send a signal to the control unit 52 in responding to an input. The control unit 52 controls the operation of the projecting device 44 and counts the number of times shot peening has been carried out on the objects W that have been carried into the area 42A for projecting (see FIG. 1). The control unit 52 controls the display 54 to display the number of times shot peening has been carried out on the objects W that have been carried into the area 42A for projecting (see FIG. 1). Incidentally, the number that is counted by the control unit 52 can be reset to start counting at a desired time. In the control unit 52, for example, a controller (not shown) for the area 42A for pre-cleaning and a controller (not shown) for the apparatus 10 for treating a surface may be separate controllers. The words "control unit 52" are used to include these controllers.

As in FIG. 1, a door 46 for opening and closing is provided to the shot-peening machine 40 so that the object is carried into, and carried out of, the cabinet 42. A device 48 for detecting that the door is open or closed is also provided to the shot-peening machine 40 to detect that the door 46 is open or closed. The device 48 for detecting that the door is open or closed functions as a proximity sensor. It has a proximity switch 48A that is provided near the gate for carrying the object in and out of the cabinet 42 and a magnet 48B that is provided near the free end of the door 46. The magnet 48B is located at a position that is near the proximity switch 48A when the door 46 is closed. The proximity switch 48A is configured to turn on a circuit (a control circuit) that includes the proximity switch 48A when the magnet 48B becomes close to it within a predetermined range. Namely, the door 46 is closed so that the magnet 48B comes close to the proximity switch 48A. Thus, the proximity switch 48A detects that the magnet 48B has come close to it. In other words, it detects that the door 46 has been closed. Incidentally, the door 46 may be opened and closed manually or automatically.

A single door 46 is provided to the shot-peening machine 40. The objects W are carried into, and carried out of, the shot-peening machine 40 through the single door 46. When the door is opened, the object W that has been subject to the shot peening is carried out of the shot-peening machine 40 and the object W that is to be subject to the shot peening is carried into it. When the object W that is to be subject to the shot peening has been carried into the shot-peening machine 40, the door 46 is closed so that the shot peening is carried out in the shot-peening machine 40. That is, the number of times the door 46 has been opened and closed matches the number of times the shot peening has been carried out.

However, the door 46 may be opened when the object W that has been subject to the shot peening is carried out of the shot-peening machine 40, and it may be closed after the object W has been carried out of it, and it may again be opened when the object W is carried into it, and it may be closed after the object W is carried into it. In this case the number of times the door 46 has been opened and closed is double the number of times the shot peening has been carried out.

Alternatively, the shot-peening machine 40 may be located between the table 30 and the table 60. A door (not shown) for carrying the object W into the machine 40 may be provided at the side near the table 30 and a door (not shown) for carrying the object W out of the machine 40 may be provided at the side near the table 60. The device 48 for detecting that the door is open or closed may be provided to one of the doors, but preferably to both doors. The number of times the door has been opened and closed, which number is counted by the device 48 for detecting that the door is open or closed at the door for carrying the object W into the machine 40, the number of times the door has been opened and closed which number is counted by the device 48 for detecting that the door is open or closed at the door for carrying the object W into the machine 40, and the number of times the shot peening has been carried out, are the same. In such a way the relationship between the number of times the door has been opened and closed and the number of times the shot peening has been carried out changes depending on the configuration of the door and on how to open and close the door. The numbers are not necessarily the same. The determination to find if the shot peening is correctly carried out is done by considering if the numbers are logically correct.

As in FIG. 2, the device 48 for detecting that the door is open or closed is connected to the control unit 52. The control unit 52 counts the number of times the door 46 (see FIG. 1) has been opened and closed based on the results detected by the device 48 for detecting that the door is open or closed. The control unit 52 controls the display 54 to display the number of times the door 46 (see FIG. 1) has been opened and closed. Incidentally, the numbers that are counted by the control unit 52 can be reset to start counting at a desired time.

As in FIG. 1, a first detecting device 32 is provided on the table 30, which is located at the upstream side (the left side in the figure) of the shot-peening machine 40 in the line L. The first detecting device 32 is composed of a device 34 for evaluating a magnetic property and a device 36 for measuring a stress.

The device 34 for evaluating a magnetic property detects the conditions of the surface of the object W that is carried into the area 42A for projecting and displays the results on the display 34D. Namely, the device 34 for evaluating a magnetic property is one that measures the electromagnetic characteristics of the object W and has a cylinder-shaped detector. The detector has a coil for exciting eddy currents in the object W. The device 34 for evaluating a magnetic property measures the condition of the entire surface of the area to be processed of the device 34, i.e., the changes in the hardness or residual stresses that are generated by the shot peening. It evaluates the presence of any unevenness and the conditions of the metallic structure by the magnetic properties to determine if the object W should be accepted. A basic configuration of the device 34 for evaluating a magnetic property may be, for example, that of the device for evaluating a magnetic property that is disclosed by Japanese Patent No. 5877505. Since the configuration is publicly known by the disclosure in the Patent Gazette, herein its details are not discussed. In the present embodiment, the device 34 for evaluating a magnetic property counts the number of objects W that are carried into the area 42A for projecting and displays it on the display 34D.

The device 36 for measuring a stress measures the conditions of the surface of the object W that is carried into the area 42A for projecting and displays the results on the display 36D. Namely, the device 36 for measuring a stress measures, by means of X-rays, the residual stresses on the surface of the object W that is located at the predetermined position. A basic configuration of the device 36 for measuring a stress may be, for example, that of the device for measuring a residual stress that is disclosed by Japanese Patent Laid-open Publication No. 2017-009356. Since the configuration is publicly known through the patent publication, herein its details are not discussed. In the present embodiment, the device 36 for measuring a stress counts the number of objects W that are carried into the area 42A for projecting and displays it on the display 36D.

A second detecting device 62 is provided on the table 60, which is located at the downstream side (the left side in the figure) of the shot-peening machine 40 in the line L. The second detecting device 62 is composed of a device 64 for evaluating a magnetic property, which is the first nondestructive inspection device, and a device 66 for measuring a stress, which is the second nondestructive inspection device.

The device 64 for evaluating a magnetic property detects the conditions of the surface of the object W that is carried out of the area 42A for projecting. Specifically, it measures the electromagnetic characteristics of the object W to display them on the display 64D. Its configuration is the same as that of the device 34 for evaluating a magnetic property. It counts the number of objects W that are carried out of the area 42A for projecting, to display it on the display 64D.

The device 66 for measuring a stress detects the conditions of the surface of the object W that is carried out of the area 42A for projecting. Specifically, it detects, by means of X-rays, the residual stress on the surface of the object W that is located at the predetermined position, to display it on the display 66D. Its configuration is the same as that of the device 36 for measuring a stress. It counts the number of objects W that are carried out of the area 42A for projecting, to display it on the display 66D.

As in FIG. 2, the device 34 for evaluating a magnetic property and the device 36 for measuring a stress, which compose the first detecting devices 32, and the device 64 for evaluating a magnetic property and the device 66 for measuring a stress, which compose the second detecting device 62, are connected to the control unit 52. The control unit 52 compares the number of objects W that have been carried into the area 42A for projecting (see FIG. 1) with the number of objects W that have been carried out of the area 42A for projecting (see FIG. 1) when all the objects W that have been carried into the area 42A for projecting (see FIG. 1) are carried out of it. This comparison is initiated manually or automatically by using a timer, etc. It is based on the data on the numbers of objects W obtained by the device 36 for measuring a stress (a part of the first detecting devices 32) and the device 64 for evaluating a magnetic property (a part of the second detecting devices 62). If the numbers do not match, the control unit 52 causes an error message on the mismatching to be displayed on the display 54, or in a general way outputs the error message.

In that comparison, the number of objects that is counted by the device 36 for measuring a stress is used, since the object W is transported to the shot-peening machine 40 just after the number of objects W is counted by the device 36 for measuring a stress that is shown in FIG. 1. In that comparison, the number of objects that is counted by the device 64 for evaluating a magnetic property is used, since the number of objects W is counted by it just after the object W is carried out of the shot-peening machine 40. Incidentally, the number of objects W that is counted by the device 34 for evaluating a magnetic property or the device 66 for measuring a stress may be used.

As in FIG. 1, a conveyor 68 is provided to the downstream side (the right side in the figure) of the table 60 in the line L. The conveyor 68 is configured to convey the object W that is placed on it in the predetermined conveying direction. In FIG. 1, which is a schematic plan view, an upstream part of it is shown at the top of the figure, and a downstream part of it is shown at the bottom of it. Both parts are connected by double-dashed lines.

A table 70 for temporarily placing the object on it, a second cleaning device 74, and a table 76 for temporarily placing the object on it, are provided to the downstream side (the left side in the figure) of the conveyor 68, which is shown at the bottom, in the line L. The second cleaning device 74 has a nozzle 74N for blowing air and is configured to clean the object W by blowing air. An area 74A for post-cleaning includes the table 70, the second cleaning device 74, and the table 76.

A first detecting device 72 is provided on the table 70, which is located at the upstream side (the right side in the figure) of the second cleaning device 74 in the line L. The first detecting device 72 is a device that functions as an image-inspecting device. It is located on the table 70 and takes an image of the surface of the object W that is carried into the area 74A for post-cleaning, to generate image data. Thus, it detects the conditions of the surface of the object W to display the result on the display 72D. It also counts the number of objects W that are carried into the area 74A for post-cleaning, to display it on the display 72D.

A second detecting device 78 is provided on the table 76, which is located at the downstream side (the left side in the figure) of the second cleaning device 74 in the line L. The second detecting device 78 takes an image of the surface of the object W that has been transported from the area 74A for post-cleaning to the table 76, to generate image data. Thus, it detects the conditions of the surface of the object W to display the result on the display 78D. It also counts the number of objects W that are carried out of the area 74A for post-cleaning, to display it on the display 78D.

As in FIG. 2, the second cleaning device 74, the first detecting device 72, and the second detecting device 78, are connected to the control unit 52. The unit 50 for the operation, which is connected to the control unit 52, is configured so that conditions for cleaning the object W by blowing air by means of the second cleaning device 74 and so on can be input. It outputs signals that correspond to the inputs to the control unit 52. Incidentally, in the control unit 52, for example, a controller (not shown) for the area 74A for post-cleaning and a controller (not shown) for the apparatus 10 for treating a surface may be separate controllers. The words "control unit 52" are used to include these controllers.

The control unit 52 compares the number of objects W that have been carried into the area 74A for post-cleaning (see FIG. 1) with the number of objects W that have been carried out of that area (see FIG. 1) when all the objects W that have been carried into the area 74A for post-cleaning (see FIG. 1) are carried out of it. This comparison is initiated manually or automatically by using a timer, etc. It is based on the data on the number of objects W obtained by the first detecting device 72 and that obtained by the second detecting device 78. If the numbers do not match, the control unit 52 causes an error message on the mismatching to be displayed on the display 54, or in a general way outputs the error message.

As in FIG. 1, a conveyor 80 is provided to the downstream side (the left side in the figure) of the table 76 in the line L. The conveyor 80 is configured to convey the object W on it in the predetermined conveying direction (the arrow X4). A table 82 for temporarily placing the object on it, a device 86 for inspecting an appearance, and a table 88 for temporarily placing the object on it, are provided to the downstream side of the conveyor 80 in the line L. The area 86A for inspecting an appearance includes the table 82, the device 86 for inspecting an appearance, and the table 88.

For example, the device 86 for inspecting an appearance is configured to include a robot 86R for inspecting an appearance (shown as a block) that has a camera for taking an image of the outer surface of the object W. The robot 86R for inspecting an appearance inspects the appearance of the object W based on the image data that has been obtained by taking the image. For example, it analyzes the image data to inspect it to see if rust adheres to the surface, or if the surface is scratched. It determines that the object W passes the inspection if no rust adheres to the surface and no surface is scratched. The robot 86R for inspecting an appearance places the object W that has passed the inspection, for example, in a tray of such objects (not shown) on the table 88 and the object W that has failed the inspection, for example, in a tray of such objects (not shown) on the table 88.

In the present embodiment, the robot 86R of the device 86 for inspecting an appearance inspects the appearance of the object W. However, instead of the robot 86R an operator may visually inspect the appearance of the object W.

A detector 84 at the upstream side is provided on the table 82, which is located at the upstream side (the right side in the figure) of the device 86 for inspecting an appearance in the line L. The detector 84 at the upstream side is located on the table 82 and takes an image of the surface of the object W that is carried into the area 86A for inspecting an appearance, to generate image data. It counts the number of objects W that are carried into the area 86A for inspecting an appearance by using the image data, to display it on the display 84D.

A detector 90 at the downstream side is provided on the table 88, which is located at the downstream side (the left side in the figure) of the device 86 for inspecting an appearance in the line L. The detector 90 at the downstream side takes an image of the surface of the object W that is transported from the area 86A for inspecting an appearance to the table 88, to generate image data. It counts the number of objects W that are carried out of the area 86A for inspecting an appearance by using the image data, to display it on the display 90D.

As in FIG. 2, the device 86 for inspecting an appearance, the detector 84 at the upstream side, and the detector 90 at the downstream side, are connected to the control unit 52. The unit 50 for the operation, which is connected to the control unit 52, is configured so that conditions for inspecting the appearance of the object W by means of the device 86 for inspecting an appearance and so on can be input. It outputs signals that correspond to the inputs to the control unit 52. Incidentally, in the control unit 52, for example, a controller (not shown) for the area 86A for inspecting an appearance and a controller (not shown) for the apparatus 10 for treating a surface may be separate controllers. The words "control unit 52" are used to include these controllers.

The control unit 52 compares the number of objects W that have been carried into the area 86A for inspecting an appearance (see FIG. 1) with the number of objects W that have been carried out of that area when all the objects W that have been carried into the area 86A for inspecting an appearance (see FIG. 1) are carried out of it. This comparison is initiated manually or automatically by using a timer, etc. It is based on the data on the numbers of objects W obtained by the detector 84 at the upstream side and the detector 90 at the downstream side. If the numbers do not match, the control unit 52 causes an error message on the mismatching to be displayed on the display 54, or in a general way outputs the error message.

As in FIG. 1, a conveyor 92 is provided to the downstream side (the left side in the figure) of the table 88 in the line L. The conveyor 92 is configured to convey the object W on it in the predetermined conveying direction (the arrow X5). A table 94 for placing the object on it is provided to the downstream side of the conveyor 92 in the line L. The object W that has been transported on the table 94 is subject to a rust-preventing treatment by a device for preventing rust (not shown).

Incidentally, it is to be noted that at a part of the line L that is not discussed in the above discussion regarding the transportation, the object W may be manually transported by an operator or may be automatically transported by a robot (not shown). The number of objects W that is counted by the first detecting devices 18, 32, 72, the detector 84 at the upstream side, the second detecting devices 24, 62, 78, or the detector 90 at the downstream side, can be reset to start counting at a desired time.

A Method for Treating a Surface and its Actions and Effects

Next, while a method of treating the surfaces of the objects W that are sequentially transported in the line L, which includes the area 20A for pre-cleaning, the area 42A for projecting, and the area 74A for post-cleaning, is discussed, the actions and effects of the embodiment are also discussed.

First, in the step of pre-cleaning, the first cleaning device 20 cleans the object W by blowing air at the area 20A for pre-cleaning. In the step of shot peening, which follows, the projecting device 44 shoots the shot on the object W that has been cleaned in the step of pre-cleaning to carry out the shot peening on it at the area 42A for projecting. In the step of post-cleaning, the second cleaning device 74 cleans the object W that has been subject to the shot peening in the step of shot peening by blowing air at the area 74A for post-cleaning.

Just before the step of pre-cleaning, the step of shot peening, and the step of post-cleaning, the object W that is carried into the areas where the steps are carried out is subject to the step of a first check. Just after the step of pre-cleaning, the step of shot peening, and the step of post-cleaning, the object W that is carried out of the areas where the steps are carried out is subject to the step of a second check.

In the steps of the first check, just before the steps of pre-cleaning, shot peening, and post-cleaning, the numbers of objects W that are carried into the areas where the steps are carried out are counted. The conditions of the surface of the object W are also detected. The numbers that are counted at these steps are displayed, for example, on the displays 18D, 34D, 36D, 72D, and 84D. In the step of the second check, just after the steps of pre-cleaning, shot peening, and post-cleaning, the numbers of objects W that are carried out of the areas where the steps are carried out are counted. The conditions of the surface of the object W are also detected. The numbers that are counted at these steps are displayed, for example, on the displays 24D, 64D, 66D, 78D, and 90D. Since the numbers of objects W and the conditions of the surface of the object W are evaluated before and after the step of pre-cleaning, the step of shot peening, and the step of post-cleaning, no step can be skipped.

By the present embodiment, the appearance of the object W that has been cleaned in the step of post-cleaning is inspected in the step of inspecting an appearance. The numbers of objects W are counted before and after the step of inspecting an appearance to display them on the displays 84D, 90D. Thus, no step of inspecting an appearance can be skipped.

By the present embodiment, the control unit 52 as in FIG. 2 compares the numbers of objects W that have been carried into the area 20A for pre-cleaning, the area 42A for projecting, the area 74A for post-cleaning, and the area 86A for inspecting an appearance, with the numbers of objects W that have been carried out of these areas at a time when all the objects W that have been carried into these areas are carried out of them. If the numbers do not match, the display 54 displays an error message, or in a general way outputs the error message. Thus, any object that has not been carried out of the areas can be easily found.

By the present embodiment, the control unit 52 counts the number of times that the door 46 has been opened and closed based on the results of the device 48 for detecting that the door is open or closed, which device is shown in FIG. 1. The control unit 52 also counts the number of times that the shot peening has been carried out on the objects W that were carried into the area 42A for projecting. The numbers are displayed on the display 54. Thus, since the number of times that the door 46 has been opened and closed is compared with the number of times that the shot peening has been carried out, carrying out the shot peening twice on one object W can be effectively prevented.

By the present embodiment, the device 64 for evaluating a magnetic property measures the electromagnetic characteristics of the object W after the object W is carried out of the area 42A for projecting. The device 66 for measuring a stress also measures the residual stress on the surface of the object W. Thus, the effect of the shot peening can be evaluated with high accuracy.

As discussed above, by the apparatus 10 for treating a surface and the method for treating a surface of the present embodiment, the object W can be definitely finished with a high quality.

Supplemental Remarks on the Embodiment

Incidentally, in a modified example the first detecting devices and the second detecting devices may include a proximity sensor that counts the number of objects. In the embodiment the first detecting devices 18, 72 and the second detecting devices 24, 78 detect the conditions of the surface of the object by taking an image of the surface of the object to generate image data. Instead of the first detecting devices 18, 72 and the second detecting devices 24, 78, detecting devices that detect the conditions of the surface of the object without generating the image data may be provided. For example, the detecting device detects them in a way that is similar to that of the first detecting device 32 and the second detecting device 62.

In a modified example of the embodiment any detecting device such as the first detecting devices 18, 32, 72, the detector 84 at the upstream side, the second detecting devices 24, 62, 78, and the detector 90 at the downstream side, may not display the number of objects that has been counted. The numbers may be managed by a system to manage the control unit 52 or may be output by sound.

In a modified example of the embodiment, the first detecting device 32, which is provided to the upstream side of the shot-peening machine 40 in the line L, may be configured to include either the device 34 for evaluating a magnetic property or the device 36 for measuring a stress. Or, it may be configured to be an image-inspecting device, which is similar to the first detecting device 18 that is provided to the upstream side of the area 20A for pre-cleaning in the line L.

In a modified example of the embodiment the second detecting device 62, which is provided to the downstream side of the shot-peening machine 40 in the line L, may be configured to include either the device 64 for evaluating a magnetic property, which is a first nondestructive inspection device, or the device 66 for measuring a stress, which is a second nondestructive inspection device. Or, it may be configured to be an image-inspecting device that is similar to the second detecting device 24, which is provided to the downstream side of the first cleaning device 20 in the line L.

In the embodiment the number of times that the door 46 has been opened and closed and the number of times that the shot peening has been carried out on the object W that has been carried into the cabinet 42 are displayed on the display 54. However, in a modified example the number of times that the door 46 has been opened and closed and the number of times that the shot peening has been carried out on the object W may be managed, for example, by a managing system in a computer such as the control unit 52, or may be output by sound.

In the embodiment the control unit 52 counts the number of times that the door 46 has been opened and closed and the number of times that the shot peening has been carried out on the object W that has been carried into the cabinet 42. However, the numbers may be counted by a managing system that is provided separately from the control unit 52.

In a modified example of the embodiment the device for detecting that the door is open or closed may detect the open status of the door or may detect both the open status and the closed status of the door. In another modified example no device for detecting that the door is open or closed is provided, and so no display displays the number of times that the door has been opened and closed.

In the embodiment the control unit 52 controls the display 54 to display an error message if the number of objects W that have been carried into the areas does not match the number of objects W that have been carried out of the areas, or in a general way the control unit 52 may output the error message. However, in a modified example, if the numbers of objects W do not match, a device for outputting sound may output an error message by sound or may output the error message to another device. In another modified example no error message may be output if the numbers of objects W do not match.

In the embodiment the first cleaning device 20 and the second cleaning device 74 clean the object W by blowing air. In a modified example they may clean the object W by using a liquid.

In the embodiment the object W is a metal product. However, depending on the configuration of the devices that constitute the apparatus for treating a surface the object may be a product that is other than one made of metal.

In the embodiment the tables 12, 94 for placing the object on them, the conveyors 14, 26, 68, 80, 92, and the tables 16, 22, 30, 60, 70, 76, 82, 88 for temporarily placing the object on them, are provided. However, instead of these members any members on which the object can be placed, such as a desk, may be provided. Or, these members need not be provided as long as the detecting devices (the first detecting devices 18, 32, 72, the detector 84 at the upstream side, the second detecting devices 24, 62, 78, and the detector 90 at the downstream side) can function.

In a modified example of the embodiment the area 86A for inspecting an appearance may be changed to an area for inspecting the conditions of the surface other than the appearance. Instead of the device 86 for inspecting an appearance any other device for inspection, such as the device 64 for evaluating a magnetic property and the device 66 for measuring a stress, may be provided.

Incidentally, the embodiment and the above modifications may be combined as appropriate.

As discussed above, an embodiment of the present invention is discussed. However, the present invention is not limited to the one that is discussed above. Clearly, it can be utilized with various modifications other than the above modifications within a scope that does not depart from the spirit of the present invention.

Below, the reference signs used in the present specification and the drawings are listed.

10 the apparatus for treating a surface
18 the first detecting device
20 the first cleaning device
20A the area for pre-cleaning
24 the second detecting devices
32 the first detecting devices
40 the shot-peening machine
42A the area for projecting
46 the door
48 the device for detecting that the door is open or closed
52 the control unit (the controller)
54 the display (the device for displaying)
62 the second detecting devices
64 the device for evaluating a magnetic property (the first nondestructive inspection device)
66 the device for measuring a stress (the second nondestructive inspection device)
72 the first detecting device
74 the second cleaning device
74A the area for post-cleaning
78 the second detecting device
L the line for treating the surface
W the object to be processed

The invention claimed is:

1. An apparatus for treating a surface that treats an object to be processed while transporting the object on a line for treating a surface, wherein the line for treating the surface includes an area for pre-cleaning, an area for projecting, and an area for post-cleaning, that are arranged from an upstream side, the apparatus comprising:

a first cleaning device that cleans the object to be processed at the area for pre-cleaning;

a shot-peening machine that carries out shot peening by shooting shots on the object to be processed at the area for projecting;

a second cleaning device that cleans the object to be processed at the area for post-cleaning;

first detecting devices that count, at upstream sides of the line for treating a surface of the area for pre-cleaning, the area for projecting, and the area for post-cleaning, a number of objects to be processed that are carried into the respective areas and that detect the conditions of the surface of the objects to be processed;

second detecting devices that count at downstream sides of the line for treating a surface of the area for pre-cleaning, the area for projecting, and the area for post-cleaning, a number of objects to be processed that are carried out of the respective areas and that detect the conditions of the surface of the objects to be processed.

2. The apparatus for treating a surface of claim 1, further comprising:

a control unit that controls operations of the apparatus for treating a surface, wherein the control unit compares the number of objects that have been carried into the areas and the number of objects that have been carried out of the areas based on the number of objects that is counted by means of the first detecting devices and the number of objects that is counted by means of the second detecting devices at a time when the objects that have been carried into the area for pre-cleaning, the area for projecting, and the area for post-cleaning, are carried out of the areas, and wherein the control unit outputs an error message if the numbers do not match.

3. The apparatus for treating a surface of claim 2, wherein the shot-peening machine has:

a door that is open when the object to be processed is carried into or carried out of the device and that is closed when the shot peening is carried out; and a device for detecting that the door is open or closed that detects that the door is open or closed;

wherein the control unit counts a number of times that the door has been opened and closed based on the results detected by the device for detecting that the door is open or closed, and wherein the control unit also counts a number of times that shot peening has been carried out on the object to be processed that has been carried into the area for projecting.

4. The apparatus for treating a surface of claim 3, wherein the second detecting devices are configured to include at least either a first nondestructive inspection device that detects electromagnetic characteristics of the object to be processed that has been carried out of the area for projecting or a second nondestructive inspection device that measures, by means of X-rays, a residual stress on a surface of the object to be processed that has been carried out of the area for projecting.

5. The apparatus for treating a surface of claim 2, wherein the second detecting devices are configured to include at least either a first nondestructive inspection device that detects electromagnetic characteristics of the object to be processed that has been carried out of the area for projecting or a second nondestructive inspection device that measures, by means of X-rays, a residual stress on a surface of the object to be processed that has been carried out of the area for projecting.

6. The apparatus for treating a surface of claim 1, wherein the second detecting devices are configured to include at least either a first nondestructive inspection device that detects electromagnetic characteristics of the object to be processed that has been carried out of the area for projecting or a second nondestructive inspection device that measures, by means of X-rays, a residual stress on a surface of the object to be processed that has been carried out of the area for projecting.

7. A method for treating a surface that treats a surface of an object to be processed that is sequentially transported through a line for treating the surface that includes an area for pre-cleaning, an area for projecting, and an area for post-cleaning, the method comprising:

the step of pre-cleaning wherein the object to be processed is cleaned at the area for pre-cleaning;

the step of shot peening wherein the object to be processed that has been cleaned in the step of pre-cleaning is subject to the shot peening by shooting the shots on the object at the area for projecting;

the step of post-cleaning wherein the object to be processed that has been subject to the shot peening in the step of shot peening is cleaned at the area for post-cleaning;

the step of a first check wherein numbers of the objects are counted that are carried into the areas where the step of pre-cleaning, the step of shot peening, and the step of post-cleaning, are carried out, and wherein the conditions of the surface of the objects are detected; and the step of a second check wherein numbers of objects are counted that are carried out of the areas where the step of pre-cleaning, the step of shot peening, and the step of post-cleaning, are carried out, and wherein the conditions of the surface of the objects are detected.

* * * * *